US005275285A

United States Patent [19]

Clegg

[11] Patent Number: 5,275,285

[45] Date of Patent: Jan. 4, 1994

[54] BUSINESS CARD HOLDER WITH SOUND GENERATING MICROCHIP

[75] Inventor: Timothy P. Clegg, Santa Monica, Calif.

[73] Assignee: Clegg Industries, Torrance, Calif.

[21] Appl. No.: 998,386

[22] Filed: Dec. 30, 1992

[51] Int. Cl.[5] ..... B42D 15/02; G09F 27/00

[52] U.S. Cl. ..... 206/449; 40/124.1; 40/455; 40/902; 206/232; 229/92.8

[58] Field of Search ..... 206/232, 449; 40/124.1, 40/455, 902; 283/56; 229/928

[56] References Cited

U.S. PATENT DOCUMENTS

| | | | |
|---|---|---|---|
| 190,588 | 5/1877 | Holding | 229/92.8 |
| 1,141,172 | 6/1915 | Clark | 229/92.8 |
| 2,107,450 | 2/1938 | Miller | 229/92.8 |
| 2,298,601 | 10/1942 | Tremblett | 229/92.8 |
| 4,607,747 | 8/1986 | Steiner | 206/232 |
| 4,614,266 | 9/1986 | Moorhead | 206/216 |
| 4,703,573 | 11/1987 | Montgomery et al. | 40/455 |
| 4,866,865 | 9/1989 | Yang | 40/455 |
| 5,063,698 | 11/1991 | Johnson et al. | 40/124.1 |

*Primary Examiner*—Bryon P. Gehman

*Attorney, Agent, or Firm*—Spensley Horn Jubas & Lubitz

[57] ABSTRACT

A business card holder, which can be used to hold business cards and actively draw the attention of a recipient to the card by emitting sounds upon the unfolding of the business card holder. The business card is held inside the holder and a sound emitting device is incorporated within the holder. When the business card holder is opened and unfolded the sound emitting device is activated to provide an audio signal to the recipient.

16 Claims, 2 Drawing Sheets

BUSINESS CARD HOLDER WITH SOUND GENERATING MICROCHIP

FIELD OF THE INVENTION

This invention relates to an audio signal emitting receptacle and, in particular embodiments, a receptacle which holds a business card or other similarly shaped object, and emits sounds when the receptacle is opened and unfolded.

BACKGROUND OF THE INVENTION

Traditionally, business cards are held in receptacles designed to hold 10 or more business cards for a person to whom the business cards belong. When the business card owner wishes to introduce his services he generally passes his card to another individual. Drawbacks from giving out business cards in this way, are that the recipient may loose the card or may have little interest in reading the card.

Another way to distribute business cards, is by enclosing them in a letter to a current or prospective client. However, if the card is loosely inserted in the letter it may be overlooked or easily lost. Moreover, if the card is stapled to the letter, it may make reading the letter difficult or may disfigure the business card, such that an unfavorable impression is created.

An alternative to sending a loose business card in a letter, is to enclose the business card in a separate holder. This makes the card more noticeable, however, it will not actively draw attention to the card or create an interest in the recipient to read and retain the card.

In a different and unrelated field of products, greeting cards have been produced with sound emitting microchip devices. These cards often provide a digital musical accompaniment, when the card is opened. This accompaniment typically follows the words in the card or fits the mood of the card. In some greeting cards, the emitted music tends to be fanciful tunes or partial renditions of familiar musical works, with the purchaser being limited to the sound selection currently incorporated in the greeting card. Typically, these cards are also preprinted with a non-customized message.

SUMMARY OF THE DISCLOSURE

It is an object of an embodiment of the present invention to provide an improved receptacle for holding objects, such as a business cards, photos, credit cards or the like, and which obviates for practical purposes, the above mentioned limitations. In particular embodiments the improved receptacle actively draws attention to the receptacle and creates an interest in the recipient by the use of audio signals, such as sounds, voice messages, speech, sound effects, musical melodies, tones or the like, to read and retain the enclosed object. In preferred embodiments the receptacle is a business card holder for holding a business card.

According to an embodiment of the invention, a business card holder has a foldable support structure to hold and protect the business card. The business card holder also includes a sound emitting device incorporated in the foldable support structure. The sound emitting device emits sounds when a user unfolds and opens the foldable support structure. Further, the foldable support structure is provided with securing means for securing a card to the foldable support structure.

In particular embodiments of the present invention, the sound emitting device is an electronic microchip sound generating device that can generate sounds related to a business (i.e. a telephone ringing, business jingles or the like), a message, a combination of words and musical tones, voice messages, speech, sound effects, musical melodies or the like. The business card holder's foldable support structure may be made from a single sheet of material, such as coated paper stock, paper board, cardboard, paper, plastic, foil or the like. The foldable support structure may hold the business card by securing means, such as slots, temporary adhesives or the like.

Other features and advantages of the invention will become apparent from the following detailed description, taken in conjunction with the accompanying drawings which illustrate, by way of example, various features of embodiments of the invention.

BRIEF DESCRIPTION OF THE DRAWING

The detailed description of embodiments of the invention will be made with reference to the accompanying drawings, wherein like numerals designate corresponding parts in the several figures.

DETAILED DESCRIPTION OF THE DISCLOSURE

Figure 1:
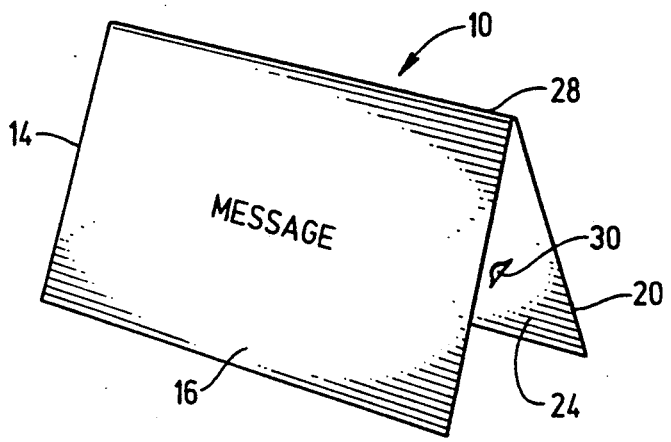
FIG. 1 is a perspective view of a substantially closed and folded business card holder according to an embodiment of the present invention.

As shown in the drawings for purposes of illustration, the invention is embodied in a receptacle for holding an object. In preferred embodiments of the present invention, the receptacle is a business card holder for holding and actively drawing attention to an enclosed business card. However, it will be recognized that further embodiments of the invention may be used to hold other objects that are similarly sized, including but not limited to photos, credit cards or the like. The business card holder draws the attention of the recipient to the enclosed business card by emitting audio signals, such as sounds, voice messages, speech, sound effects, musical melodies, tones or the like.

FIG. 1 shows an embodiment of a business card holder 10, in a perspective view having a substantially folded and closed state. This embodiment of the present invention is designed to hold a single business card. For example, it may be used to actively attract and retain the attention of a recipient of the business card. A sound emitting device 12 is activated to emit audible signal indicia (i.e. sounds, voice messages, speech, sound effects, musical melodies, tones and the like), and may be used to actively draw attention to the enclosed business card upon the unfolding of the business card holder 10. Preferably, the sound emitting device 12 creates a sound which instills a memory cue in the recipient, so that they more readily remember the received card and retain it for longer periods of time. Therefore, the business card holder 10 can be used as a very effective advertisement or promotional device.

As shown in FIG. 1, the business card holder 10 is comprised of a sound housing portion 14 and a card holding portion 20. The two portions each form an equal half of the business card holder 10 and are separated by a fold 28 to form a foldable support structure. The foldable support structure may be made of various suitable materials, such as coated paper stock, paper board, cardboard, paper, plastic, foil or the like. The sound portion 14 has an outer surface 6 on which printed indica, such as a logo, message, design or the like may be imprinted. The card portion 20 has an inner surface 24 provided with securing means for securing a business card to the business card holder 10. In the embodiment of FIG. 1, the securing means comprises a plurality of slots 30 provided in the inner surface 24 to hold a business card. However, in further embodiments, the business card may be secured to the inner surface 24 by other securing means, such as temporary adhesive material or the like.

Figure 2:
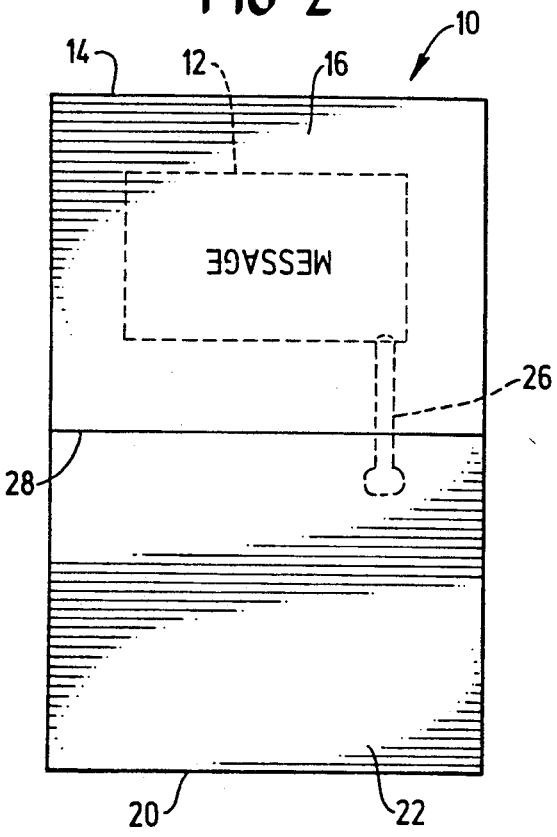
FIG. 2 is a unfolded view of the outer surfaces of the embodiment of FIG. 1.

FIG. 2 shows the business card holder 10 in an unfolded open state. FIG. 2 also shows that the complete outer surface is comprised of outer surfaces 16 and 22 of the respective portions 14 and 20. As can be further seen from FIG. 2, the business card holder 10 is divided into the two equal halves (portions 14 and 20) along the fold 28. However, it should be understood that other embodiments utilizing unequal size portions are possible. FIG. 2 also illustrates that printed indicia, such as a message, logo, design or the like may be placed as shown on surface 16 so as to make the printed indicia easy to read when the business card holder 10 is in the folded state, as shown in FIG. 1. It should be noted, that in other embodiments of the present invention, surfaces 18, 22 and 24 (shown in FIGS. 2 and 3) may also carry printed indicia.

Figure 3:
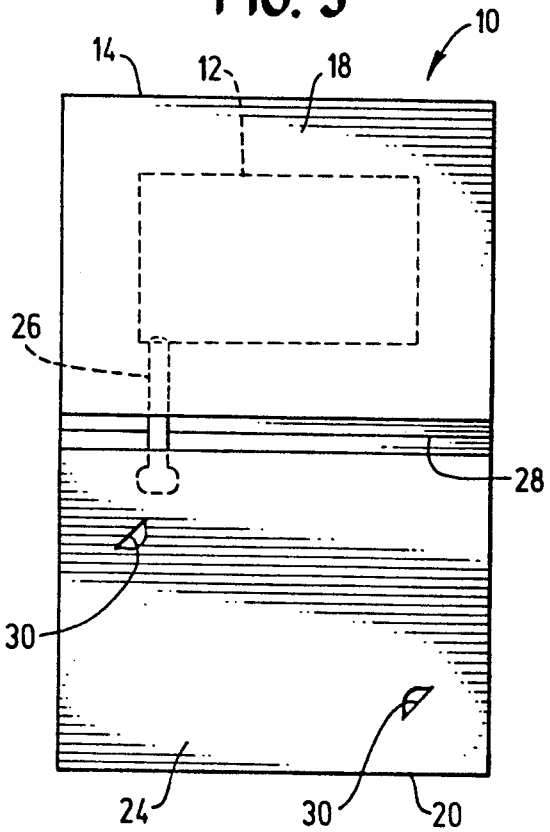
FIG. 3 is an unfolded view of the inner surfaces of the embodiment of FIG. 1.

The sound emitting device 12 (shown as broken lines) is housed in the sound housing portion 14 and is incorporated between the outer surface 16 and the inner surface 18 (shown in FIG. 3). The sound emitting device 12 used in the illustrated embodiment of the present invention is a sound generating microchip device, for example, but not limited to a Sound Generator model HT-2812 1 produced by Holtek Microelectronics Inc. of Taiwan R.O.C. Such microchip devices may be configured to produce a variety of sounds or messages, such as a telephone ringing, business jingles, voice messages, speech, sound effects, musical melodies, tones or the like.

Connected to the sound emitting device 12 is a slide tongue mechanism 26 (shown as a dotted line in FIG. 2) which acts as a trigger and is connected at one end to a switch (not shown) on the sound emitting device 12. The other end of the tongue mechanism 26 is connected to the card holding portion 20. The tongue mechanism 26 may be made from coated paper stock, paper board, cardboard, plastic or the like, and may be connected to the sound emitting device 12 and the card portion 20 by adhesives, glues or the like. Upon unfolding and opening of the business card holder 10 the tongue mechanism 26 operates the switch on the sound emitting device 12, and thereby activates the sound emitting device 12, causing sounds to be generated. These sounds actively catch and draw the recipient's attention to the unfolded business card holder 10. The sounds may be emitted until the business card holder 10 is folded or may continue for a predetermined period of time after unfolding or folding the business card holder 10.

FIG. 3 shows an inner surface view of the business card holder 10 when viewed from the direction opposite that of FIG. 2. The business card holder has an inner surface comprised of inner surfaces 18 and 24 corresponding to the respective portions 14 and 20. The sound emitting device 12 is again shown in broken lines, since device 12 is between two panels, with one panel defining surface 16 and the other panel defining surface 18 of sound portion 14. In FIG. 3, a section of the tongue mechanism 26 that crosses over the fold 28 is exposed, while sections of the tongue mechanism 26 not exposed, are connected to the sound emitting device 12 and the card portion 20 as shown in dotted lines.

In further embodiments of the present invention, the business card holder 10 utilizes a user activated switch means, such as a pushbutton, a switch or like, to activate the sound emitting device 12, such as a electronic microchip sound generating device, an electronic voice chip device or the like. This switch means may be used instead of or in addition to the slide tongue mechanism 26 described above. Activation of the switch means causes audio signals, such as sounds, voice messages, speech, sound effects, musical melodies, tones or the like, to be generated for a predetermined period of time (i.e. 10 seconds or the like), whether the business card holder 10 is in a folded or unfolded state. Further, the business card holder 10 may use a plurality (not shown) of sound emitting devices 12 to achieve a variety of audio signal combinations, not obtainable by a single chip.

Figure 4:
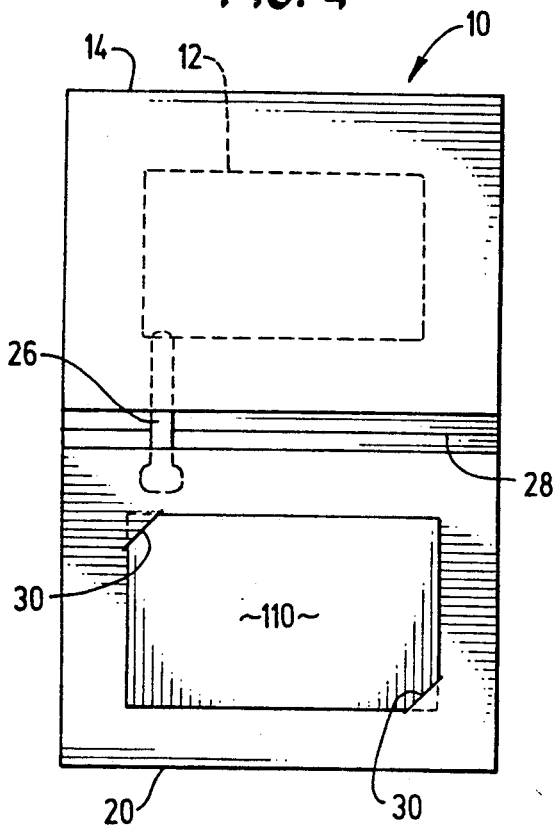
FIG. 4 is an unfolded view of the embodiment of FIG. 3 with a card business card attached and held.

FIGS. 3 and 4 show that the slots 30 are provided in the surface 24 to coincide with two of the four corners of a standard sized business card 110. The slots 30 are shaped to receive two corners of a business card 110 as shown in FIG. 4. In other embodiments of the present invention there may be additional slots 30 or the slots 30 may be arranged for cards, or the like, of different sizes. Further, the business card may be mounted by other types of securing means, such as temporary adhesive material or the like.

FIG. 4 illustrates the unfolded business card holder 10 shown in FIG. 3 holding a business card 110. As can be seen from FIG. 4, the two diagonally opposing corners of the card 110 are inserted into the slots 30. This holds the card 110 against the inner surface 24 of the card portion 20.

Figure 5:
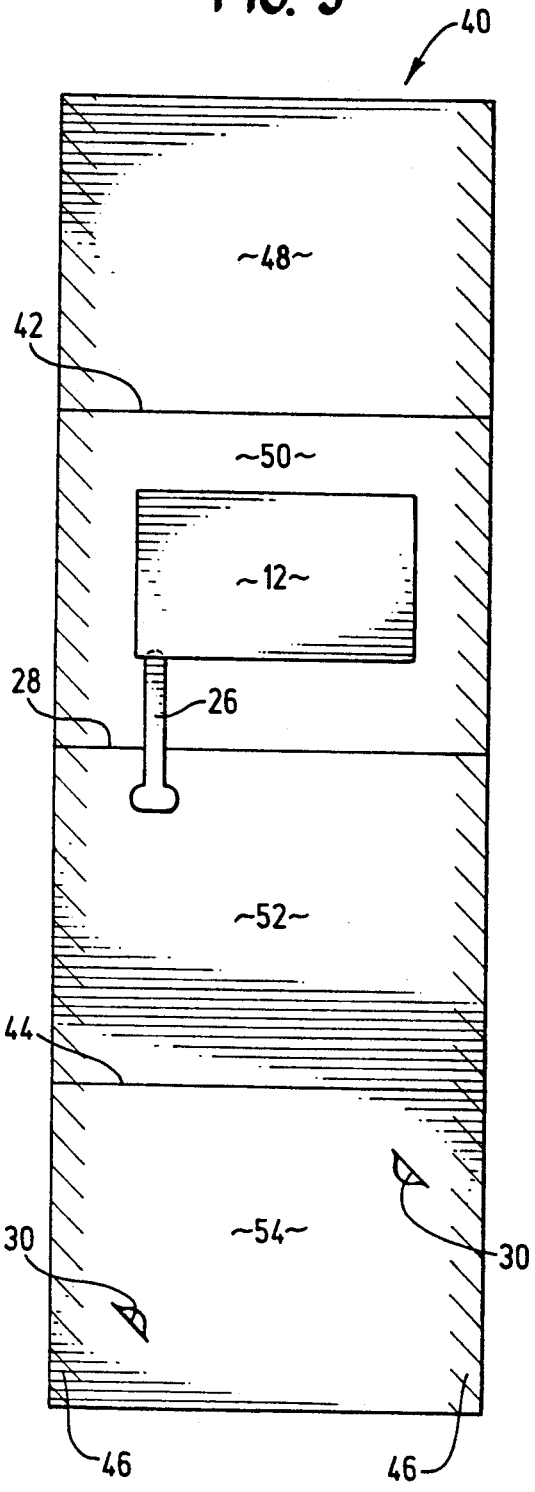
FIG. 5 is a view of the business card holder of the embodiment shown in FIGS. 1–4 prior to assembly.

FIG. 5 shows the embodiment of the business card holder 10 shown in FIGS. 1–4 prior to assembly into a finished product. This figure also demonstrates how the illustrated embodiment of the business card holder 10 may be easily and inexpensively manufactured from a single sheet of material 40. In the illustrated embodiment, the material 40 may be made of coated paper stock, paper board, cardboard, paper, plastic, foil or the like. The material 40 may be scored at folds 28, 42 and 44 to make folding of the material 40 easier. Slots 30 are cut into the panel 54 prior to assembly to ease manufacturing and costs. The sound emitting device 12 is attached to panel 50, by adhesives or the like, prior to final assembly. The slide tongue mechanism 26 has one end connected to the switch (not shown) on the sound emitting device 12 attached to panel 50, and the other end is connected to panel 52 after crossing fold 28. The tongue mechanism's tension is set so as to activate the sound emitting device 12 upon the unfolding and opening of the business card holder 10. Preferably, all printed messages are placed on the material 40 prior to final assembly.

To assemble the business card holder 10, adhesive material 46, such as tape, glue, paste or the like, is placed on the two edges of the material 40, as shown in FIG. 5. Panels 48 and 50 of material 40 are folded together along fold 42 to create the sound housing portion 14. Panels 52 and 54 of material 40 are folded together along fold 44 to create the card holding portion 20. The business card holder 10 is then folded in half along fold 28. After final assembly, a card may be inserted and secured to the business card holder 10, as shown in FIG. 4, for presentation to a recipient.

Further embodiments may be used to hold other objects, such as photos, credit cards or the like. For instance, other embodiments could be used as a new credit card delivery cover. The sound could be message to go use the card, to sign the card, to tell the recipient his credit limit or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A business card holder comprising:

(a) a foldable support structure comprising means for securing a card thereto;

and (b) means for emitting a sound incorporated into the foldable support structure, and operational to emit sounds upon unfolding of operational to emit sounds upon unfolding of the foldable support structure, said means comprising (i) an electronic microchip sound generating device, and (ii) a slide tongue mechanism having two ends, wherein one of the two ends is connected to the electronic microchip sound generating device and the other end is attached to the foldable support structure, so as to activate the electronic microchip sound generating device upon the unfolding of the foldable support structure.

2. A business card holder according to claim 1, wherein the foldable support structure is made of folded cardboard.

3. A business card holder according to claim 2, wherein the means for emitting a sound is sandwiched between panels of the folded cardboard.

4. A business card holder according to claim 1, wherein the foldable support structure has a first surface, and wherein the means for securing a card comprises slots formed in the first surface which are adapted to hold a card therein.

5. A business card holder according to claim 1, wherein the means for securing a card comprises an adhesive material attached to the foldable support structure.

6. A business card holder according to claim 1, wherein the electronic microchip sound generating device generates a sound of a ringing telephone.

7. A business card holder according to claim 1, wherein the electronic microchip sound generating device generates an audio message comprised of words.

8. A business card holder according to claim 1, wherein the electronic microchip sound generating device generates a musical arrangement of tones.

9. A business card holder according to claim 1, wherein the means for emitting a sound further comprises switch means for activating the electronic microchip sound generating device, and which is activated independent of the unfolding of the foldable support structure, such that sounds are emitted for a predetermined period of time after activation of the electronic sound generating device.

10. A method of making a business card holder, comprising the steps of:

forming a foldable support structure;

incorporating means for emitting a sound into the foldable support structure for emitting a sound upon the unfolding of the foldable support structure, said means comprising (i) an electronic microchip sound generating device, and (ii) a slide tongue mechanism having two ends, with one of the two ends being connected to the electronic microchip sound generating device and the other end being attached to the foldable support structure, so as to activate the electronic microchip sound generating device upon the unfolding of the foldable support structure;

and providing the foldable support structure with means for securing a card to the foldable support structure.

11. A business card holder for holding a card, the business card holder comprising:

(a) a foldable support structure having a first portion and a second portion with a fold between the first and the second portions;

(b) a sound emitting device incorporated into the first portion of the foldable support structure; and (c) a slide tongue mechanism for activating the sound emitting device upon the unfolding of the foldable support structure, the slide tongue mechanism having two ends, one of the two ends being connected to the sound emitting device in the first portion and the other end being connected across the fold to the second portion of the foldable support structure wherein the second portion of the foldable support has a surface with slots formed therein which are adapted to hold a card attached to the surface, such that the card is hidden from view when the foldable support structure is folded, and wherein the card is visible and sound is emitted upon unfolding of the foldable support structure.

12. A receptacle, comprising:

(a) a foldable support structure comprising means for securing an object thereto;

and (b) means for emitting a sound incorporated into the foldable support structure, and operational to emit sounds upon unfolding of the foldable support structure, said means comprising (i) an electronic microchip sound generating device, and (ii) a slide tongue mechanism having two ends, wherein one of the two ends is connected to the electronic microchip sound generating device and the other end is attached to the foldable support structure, so as to activate the electronic microchip sound generating device upon the unfolding of the foldable support structure.

13. A receptacle according to claim 12, wherein the foldable support structure is of folded cardboard, and wherein the means for emitting a sound is sandwiched between panels of the folded cardboard.

14. A receptacle according to claim 12, wherein the foldable support structure has a first surface, and wherein the means for securing an object comprises slots formed in the first surface which are adapted to hold an object therein.

15. A receptacle according to claim 12, wherein the means for securing an object comprises an adhesive material attached to the foldable support structure.

16. A receptacle according to claim 12, wherein the means for emitting a sound further comprises switch means for activating the electronic microchip sound generating device, and which is activated independent of the unfolding of the foldable support structure, such that sounds are emitted for a predetermined period of time after activation of the electronic sound generating device.

* * * * *